US010538356B2

(12) United States Patent
Ushidate et al.

(10) Patent No.: US 10,538,356 B2
(45) Date of Patent: Jan. 21, 2020

(54) FILM FITTING HEAD

(71) Applicant: Fuji Seal International, Inc., Osaka, Osaka-shi (JP)

(72) Inventors: Toshiyuki Ushidate, Osaka (JP); Yasuyuki Kawauchi, Osaka (JP)

(73) Assignee: Fuji Seal International, Inc., Osaka-shi (JP)

( * ) Notice: Subject to any disclaimer, the term of this patent is extended or adjusted under 35 U.S.C. 154(b) by 79 days.

(21) Appl. No.: 15/739,574

(22) PCT Filed: Mar. 7, 2016

(86) PCT No.: PCT/JP2016/057036
§ 371 (c)(1),
(2) Date: Dec. 22, 2017

(87) PCT Pub. No.: WO2016/208226
PCT Pub. Date: Dec. 29, 2016

(65) Prior Publication Data

US 2018/0273227 A1 Sep. 27, 2018

(30) Foreign Application Priority Data

Jun. 23, 2015 (JP) ..... 2015-125795

(51) Int. Cl.
*B65C 3/06* (2006.01)
*B65C 9/00* (2006.01)
*B65C 9/02* (2006.01)

(52) U.S. Cl.
CPC ..... *B65C 3/065* (2013.01); *B65C 9/0065* (2013.01); *B65C 9/02* (2013.01)

(58) Field of Classification Search
USPC ..... 156/85–86, 305, 497, 499, 556, 566
See application file for complete search history.

(56) References Cited

U.S. PATENT DOCUMENTS 4,302,275 A 11/1981 Burmeister et al.
8,293,047 B2 * 10/2012 Minganti ..... B65C 3/065 156/497
2010/0181009 A1 7/2010 Minganti

FOREIGN PATENT DOCUMENTS

DE 10023658 C1 10/2001
DE 102005061648 A1 6/2007
(Continued)

OTHER PUBLICATIONS

"European Application Serial No. 16813997.0 Extended European Search Report dated Jan. 28, 2019", 8 pgs.
(Continued)

*Primary Examiner* — Jeffry H Aftergut
(74) *Attorney, Agent, or Firm* — Schwegman Lundberg & Woessner, P.A.

(57) ABSTRACT

Disclosed herein is a film fitting head which holds a tubular film fitted on a mandrel in a stable position and can prevent the film from rotating and being displaced in a peripheral direction. The film fitting head (40) includes a mandrel (M) for receiving a tubular film (L) in a fitted state in a film supply position, feeding the tubular film in a film fitting position, and fitting the tubular film onto a body portion of a container. The mandrel (M) includes a film holding portion (85) provided above a lifting member (88) located in a standby position. An outer peripheral surface of the film holding portion (85) has a tapered surface that is tapered down toward a top, and an outer peripheral length of a lower end (85*a*) of the film holding portion (85) is set to be approximately equal to a peripheral length of the tubular film (L) in an open state.

7 Claims, 12 Drawing Sheets

(56) References Cited

FOREIGN PATENT DOCUMENTS

| | | | |
|---|---|---|---|
| EP | 1388496 | A1 | 2/2004 |
| EP | 2160329 | B1 | 1/2013 |
| JP | 2010530832 | A | 9/2010 |
| JP | 5686716 | B2 | 1/2013 |
| WO | WO-2004/067385 | A1 * | 8/2004 |
| WO | WO-2011015981 | A1 | 2/2011 |
| WO | WO-2014006033 | A1 | 1/2014 |

OTHER PUBLICATIONS

"International Application Serial No. PCT/JP2016/057036 International Preliminary Report on Patentability dated Dec. 26, 2017", (Dec. 26, 2017), 5 pgs.
"International Application Serial No. PCT/JP2016/057036 Search Report dated May 10, 2016", (May 10, 2016), 6 pgs.
"International Application Serial No. PCT/JP2016/057036 Written Opinion dated May 10, 2016", (May 10, 2016), 9 pgs.

* cited by examiner

X Side

FILM FITTING HEAD

CROSS-REFERENCE TO RELATED APPLICATIONS

This application is a U.S. National Stage Filing under 35 U.S.C. 371 form International Application No. PCT/JP2016/057036, filed on Mar. 7, 2016, and published as WO2016/208226 on Dec. 29, 2016, which application claims the benefit of Japanese Patent Application No. 2015-125795, filed on Jun. 23, 2015, which applications are incorporated herein by reference in their entirety.

TECHNICAL FIELD

The present invention relates to a film fitting head fitting a tubular film onto a body portion of a container.

BACKGROUND ART

For example, Patent Document 1 (Japanese Patent No. 4698803) discloses a film fitting device fitting a tubular film on a periphery of a cap portion of a container in a film fitting position where the container is transported in sequence. This film fitting device includes a plurality of mandrels that circulate through a film supply position in which the mandrel receives a tubular film in an open state and a film fitting position in which the film is fitted onto the container. In the film supply position, a tubular film, which is formed through cutting a long tubular film member that is flattened in a sheet into a predetermined length, is delivered in an approximately tubular open state to the mandrel. At this time, the tubular film is individually fed in an approximately tubular open state from a film supply device by a feeding roller, and fitted from a tip of the mandrel onto the outer peripheral surface of the mandrel.

The mandrel having the outer peripheral surface onto which the film has been fitted moves to the film fitting position. Then, a pushing bar protruding from the outer peripheral surface of the mandrel and provided movably in the axial direction of the mandrel moves to push an end portion of the film. Accordingly, the film is pushed out in an open state from the mandrel, and fitted onto a periphery of the cap portion of the container.

CITATION LIST

Patent Documents

PATENT DOCUMENT 1: Japanese Patent No. 4698803

SUMMARY OF THE INVENTION

Technical Problem

Patent Document 1 discloses the film fitting device in which the film is pushed in an approximately tubular open state from the mandrel and fitted onto the cap portion (or a body portion) of the container. In this film fitting device, the tubular film is smoothly fitted and fed along the outer peripheral surface of the mandrel. Thus, in general, the mandrel has a diameter slightly smaller than the tubular film in an open state.

However, when the film vigorously fed in an open state from the film supply device is fitted on the mandrel, the film bounces off and reaches a position of the pushing bar located on a standby position in the film supply position. This might cause variations of the fitting holding position in which the tubular film is held on the mandrel. If the film holding position with respect to the mandrel varies in this manner, the operation of delivering and fitting the tubular film from the mandrel to the container, and the fitting position of the film with respect to the container are unstable. This might cause an improper mounted state or an improper mounted position of the film mounted on the container in the end. Such problems occur particularly when the film feeding speed from the film supply device to the mandrel increases to perform a high speed operation to improve the productivity of the film fitting device.

It is an object of the present invention to provide a film fitting head allowing a tubular film fitted on the mandrel in the label supply position to be held in a stable manner to reduce fitting failure of the film on the container.

Solution to the Problem

The film fitting head of the present invention is directed to a film fitting head fitting a tubular film on a body portion of a container from below the container, the film fitting head comprising: a mandrel circulating through a film supply position and a film fitting position, receiving the tubular film in an open state in the film supply position, holding the tubular film on a film holding portion that is an outer peripheral surface of a mandrel, moving to the film fitting position, and guiding and feeding the tubular film to the body portion of the container when lifting the tubular film in the film fitting position and fitting the tubular film on the body portion of the container; a lifting member moving up from a standby position to a film lifting position in the film fitting position to lift the tubular film held on the film holding portion of the mandrel toward the body portion of the container, wherein the mandrel includes the film holding portion disposed above the lifting member located in the standby position, the outer peripheral surface of the film holding portion has a tapered surface that is tapered down toward a top, and an outer peripheral length of a lower end of the film holding portion is set to be approximately equal to a peripheral length of the tubular film in an open state.

In the film fitting head of the present invention, the mandrel includes a mandrel shaft having a tip portion of a frustum form and having an outer peripheral surface having a plurality of guide grooves formed in a shaft axial direction; and a plurality of film feeding guides movable in a vertical direction along the guide grooves between a film receiving position in which an upper end of each of the film feeding guides respectively arranged in the guide grooves of the mandrel shaft is retreated below the tip portion of the mandrel shaft and a film feeding position in which the upper end projects around the tip portion of the mandrel shaft to allow the tubular film to be fed in an open state to be approximately the same size as an outer circumferential shape of the body portion of the container, and the film holding portion composed of the tapered surface in the mandrel is comprised of external surfaces of the mandrel shaft and the film feeding guides.

In this case, it is preferred that the guide grooves of the mandrel shaft and the film feeding guides are, when viewed from the vertical direction, arranged in positions respectively corresponding to corners of the body portion having an approximately rectangular shape with rounded corner portions.

In this case, at least one groove may be formed on each of the external surfaces of the film feeding guide.

Advantages of the Invention

In the film fitting head of the present invention, the mandrel includes the film holding portion disposed above the lifting member located in the standby position. The outer peripheral surface of the film holding portion has a tapered surface that is tapered down toward a top so that an outer peripheral length of a lower end of the film holding portion is approximately equal to a peripheral length of the tubular film in an open state. Thus, after the film is fitted in an open state from a tip portion of the mandrel, a lower end of the film in an open state comes into contact with a lower end of the film holding portion of the mandrel to reach a holding position. Thus, the tubular film fitted onto the mandrel is held in a stable position without collision with the lifting member. As a result, the operation of fitting the film onto the container in the film fitting position can be reliably conducted. Thus, the fitting failure of the film onto the container can be reduced.

DESCRIPTION OF EMBODIMENTS

An embodiment of the present invention will be described in detail below with reference to the accompanying drawings. Specific shapes, materials, values, directions, or other features described herein are provided by way of illustration for ease of understanding of the present invention and may be changed as desired in accordance with the use, purpose, requirements, or other factors. If the following description includes two or more embodiments or other modifications, it is already contemplated that the features employed therein may be used in any desired combination.

In the illustrated embodiment, a tubular film to be attached on an outer periphery of a pot portion of a container is a heat-shrinkable label. Note that the tubular film may be any tubular film other than a label, such as a heat-shrinkable transparent film for bundling an attachment product together with a container.

In an example in the following description, a label fitting system transports and fits a label on a 4-pot pack, which is a container pack integrally including two rows by two sets of, a total of four, containers, each container containing contents such as yogurt. However, a container transport device and a label fitting unit according to the illustrated embodiment are not limited to this example. The illustrated embodiment may be applied to, for example, a 2-pot pack integrally including two rows by one set of, a total of two, containers, a 6-pot pack integrally including two rows by three sets of, a total of six, containers, or a 9-pot pack integrally including three rows by three sets of, a total of nine, containers, or may also be applied to a case where labels are fitted on containers that are individually separated, while the containers are being transported continuously.

Figure 1:
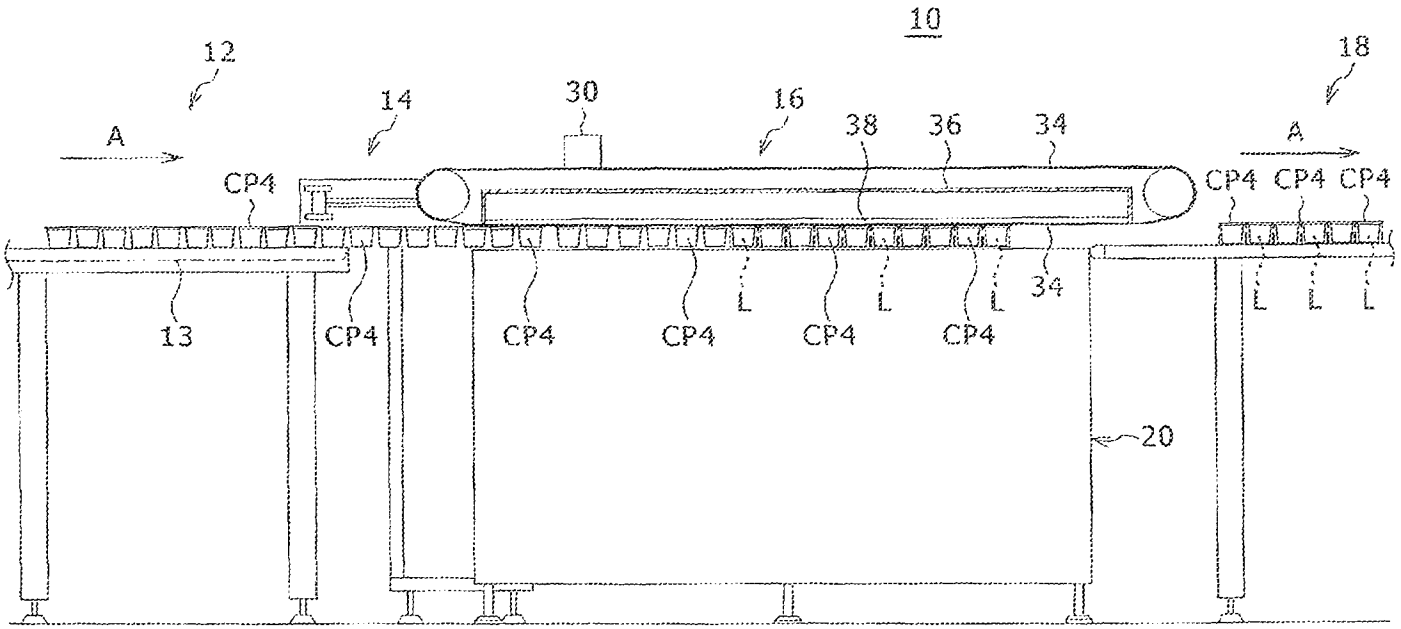
FIG. 1 is a front view illustrating an overall structure of a label fitting system including mandrel heads according to an embodiment of the present invention.
Figure 2:
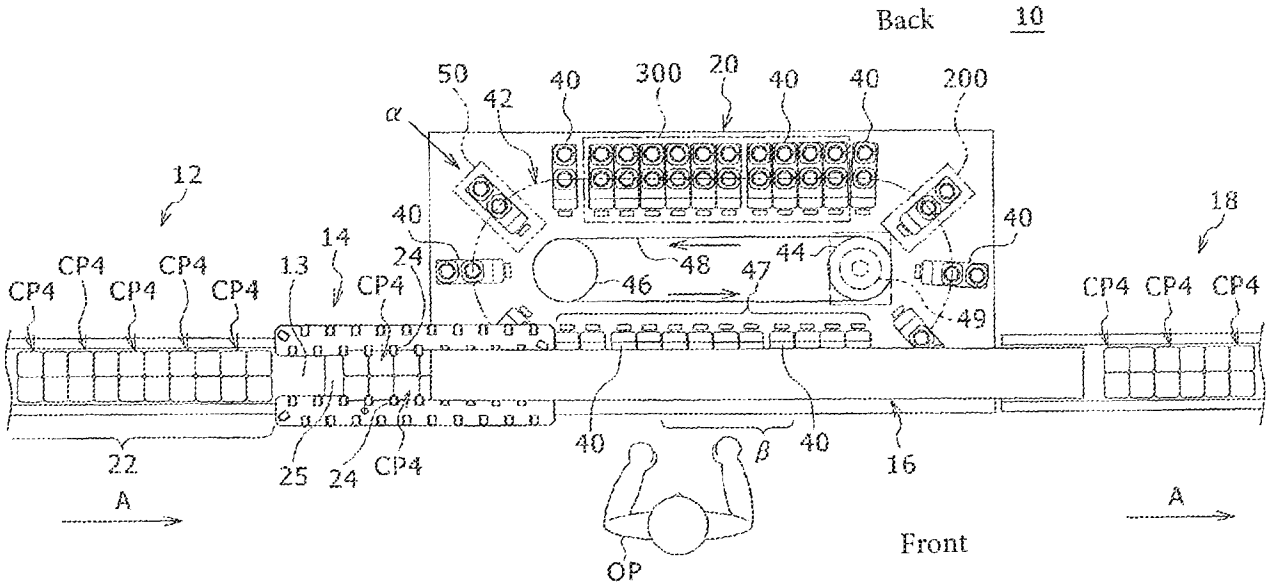
FIG. 2 is a top view of the label fitting system illustrated in FIG. 1 as viewed from above.
Figure 3:
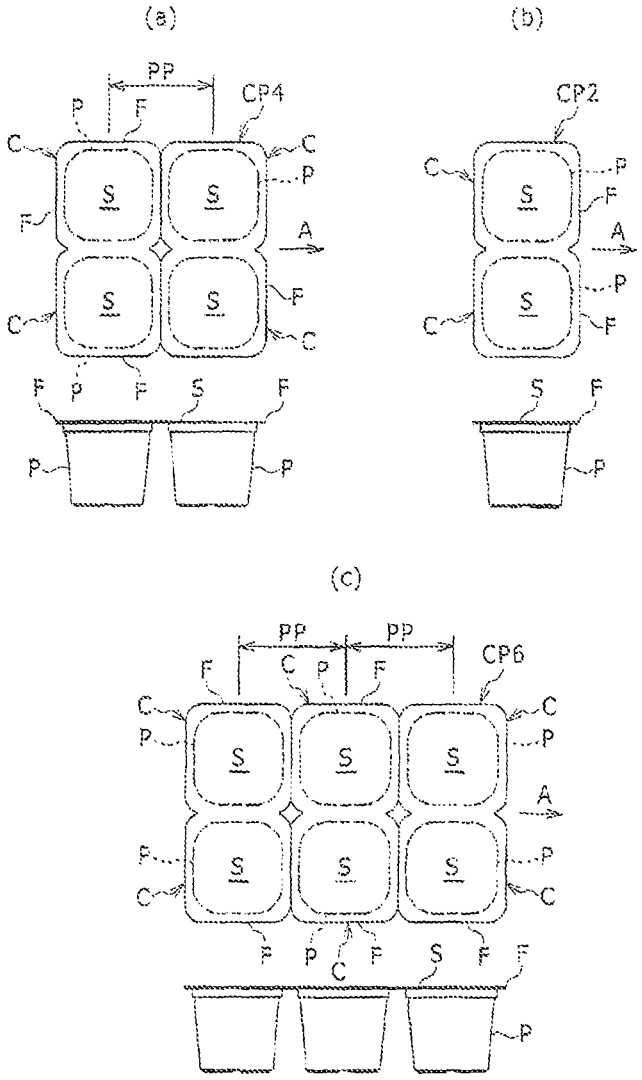
FIG. 3(*a*) illustrates a top view and a side view of a 4-pot pack, FIG. 3(*b*) illustrates a top view and a side view of a 2-pot pack, and FIG. 3(*c*) illustrates a top view and a side view of a 6-pot pack.

FIG. 1 is a front view illustrating an overall structure of a label fitting system 10 including mandrel heads (film fitting heads) 40 according to an embodiment of the present invention. FIG. 2 is a top view of the label fitting system 10 illustrated in FIG. 1 as viewed from above. FIG. 3(*a*) illustrates a top view and a side view of a 4-pot pack, FIG. 3(*b*) illustrates a top view and a side view of a 2-pot pack, and FIG. 3(*c*) illustrates a top view and a side view of a 6-pot pack.

As illustrated in FIGS. 1 and 2, the label fitting system 10 includes a first container transport device 12, a second container transport device 14, a third container transport device 16, and a fourth container transport device 18 which are disposed, in this order, in a container transport direction denoted by the arrows A. The label fitting system 10 further includes a label fitting unit 20 that is disposed along the third container transport device 16.

The first container transport device 12 transports a container pack CP4 composed of a 4-pot pack as illustrated in FIG. 3(*a*) after it is produced by a production apparatus, which is not illustrated, to feed the container pack CP4 into the label fitting system 10. The first container transport device 12 is driven to circulate an endless conveyor belt 13 so that container packs CP4 placed on the conveyor belt 13 are linearly transported in the direction of the arrows A.

The fourth container transport device 18 has the function of exporting, from the label fitting system 10, container packs CP4 having labels fitted on outer peripheries of their pot portions, and is configured in a similar manner as for the first container transport device 12 described above.

As illustrated in FIG. 3(*a*), the container pack CP4 integrally includes two rows by two sets of, a total of four, containers C. Each of the containers C has a pot portion P that is recessed so that it can contain contents such as yogurt, a flange portion F that is formed on the perimeter of an upper opening of the pot portion P to project laterally, and a sheet lid S that seals the upper opening of the pot portion P. These four containers C are integrally connected together via edge portions of the flange portions F that have approximately square outlines.

The pot portion P of each of the containers C is formed to have an upper opening of an approximately rectangular shape with rounded corners. Side walls of the pot portion P are formed to have a shape that is tapered from the top opening toward the bottom located at its lower end. The pitch between pot portions P of two containers C that are adjacent to each other in the container transport direction A in a container pack CP4 integrally including four containers C is set to a predetermined pitch PP that is defined by a forming die of a forming machine, which will be described later. Further, a through hole having an approximately rectangular shape is formed in a center portion of the container pack CP4 that is surrounded by the flange portions F of the four containers C.

Still further, a trade name or other information, which is not illustrated, is printed on the lids S that seal the upper openings of the containers C. A shallow rupture-facilitating groove for facilitating the rupture and separation into individual containers C may be formed in a connecting portion between the flange portions F.

For example, a container pack CP4 as described above may be produced by a method described below. First, a resin sheet is supplied to a forming machine of a production apparatus. In the forming machine, this resin sheet is placed in a forming die including a male die having aligned projections for forming pot portions and a female die having aligned recesses for forming inner surfaces of a shape conforming to the outer circumferential surfaces of the pot portions. Recesses corresponding to the pot portions P of the containers C are formed in this manner. The above-described operation for forming pot portions, including the steps of intermittently supplying a resin sheet and closing and opening the forming die, is repeated to form a container intermediate product including a plurality of pot portions P that are formed with a predetermined pitch PP.

The container intermediate product fed from the forming machine is then supplied to a filling machine. In the filling machine, contents such as yogurt are injected to fill the pot portions P of the container intermediate product through the upper openings. Subsequently, the sheet lid S is thermally affixed to the flange portions F on the upper surface of the container intermediate product to hermetically seal the upper openings of the pot portions P. A container pack continuous product including a plurality of container packs CP4 that are connected by the flange portions F is fed from the filling machine.

The container pack continuous product is then split into the container packs CP4, each container pack integrally including a predetermined number of containers C. In the illustrated embodiment, the container pack continuous product is split so that each container pack integrally includes two rows by two sets of, a total of four, containers C, as described above, to produce the container packs CP4. Subsequently, the container packs CP4 are supplied onto the conveyor belt 13 of the first container transport device 12 to be transported to the second container transport device 14.

Referring again to FIGS. 1 and 2, the container packs CP4 transported from the production apparatus by the first container transport device 12 are temporarily accumulated in a container storage section 22 before entering the second container transport device 14. Then, the container packs CP4 are transported by the second container transport device 14 while allowing pitch-feeding between the container packs CP4 with the transport pitch being adjusted to the predetermined pitch PP between the pot portions P of the container pack CP4.

Specifically, the second container transport device 14 includes a plurality of moving tabs 24 that move in the container transport direction A on both sides of a container transport path 25 that is linear and is contiguous to the first container transport device 12. The plurality of moving tabs 24 are configured to circulate while drawing an approximately track-like movement trajectory (a shape formed by coupling ends of two arcs with two straight lines: the same applies the following descriptions) on both sides of the container transport path 25. Driving mechanisms for the moving tabs 24 that move linearly along the container transport path 25 shaped like a linear band may have the same structure on both sides of the container transport path 25.

Each of the moving tabs 24 has a supporting upper surface and a tip outer circumferential surface. The supporting upper surface comes into abutment with lower surfaces of the flange portions F of the containers C included in the container packs CP4 to support them in a suspended manner. The tip outer circumferential surface fits between the pot portions P of the containers C to come into contact with outer peripheries of two pot portions P that are adjacent to each other in the transport direction A. In the illustrated embodiment, it is preferred that the tip outer circumferential surfaces of the moving tabs 24 are formed in a semicircular shape. The formation of the tip outer circumferential surfaces in such a shape allows smooth entry between container packs CP4 having a narrow interval between pot portions P as the interval between the pot portions P is increased, and allows pitch-feeding of the container packs CP4 with the transport pitch being adjusted to the predetermined pitch PP.

The container packs CP4 that are transported by the second container transport device 14 with the predetermined pitch PP are passed to the third container transport device 16. The third container transport device 16 includes an endless conveyor belt 34 having a lower surface that linearly moves in the container transport direction A. The conveyor belt 34 is a suction transport belt that transports, when driven to rotate at a constant speed, the container packs CP4 for which the pitch-feeding has been performed by the second container transport device 14 with the predetermined pitch PP, while maintaining the state of the container packs CP4 and sucking the top surfaces of the container packs CP4.

The conveyor belt 34 has a plurality of through holes, which are not illustrated. Inside the conveyor belt 34 that is in the form of a loop, a suction box 36 is disposed adjacent to the lower surface of the conveyor belt 34. The bottom wall of the suction box 36 has a slit 38 extending in the container transport direction A. The suction box 36 is connected to a suction source such as a pump, which is not illustrated. This configuration allows the conveyor belt 34 of the third container transport device 16 to suck the top surfaces of the container packs CP4 (in other words, the upper surfaces of the container packs CP4 sealed by the lids S) that are transported by the second container transport device 14 against the lower surface of the belt to transport the container packs CP4 in a suspended manner. In this process, the transport in a suspended manner is performed while the pitch between the container packs CP4 for which the pitch-feeding is performed by the second container transport device 14 is being maintained.

Next, the label fitting unit 20 of the label fitting system 10 will be described below. As illustrated in FIG. 1, the label fitting unit 20 is disposed below the third container transport device 16 that transports the container packs CP4 in a suspended manner. As illustrated in FIG. 2, if it is assumed that the space from which an operator OP can operate the label fitting system 10 is the front, and that the opposite side that is across the third container transport device 16 is the back, the label fitting unit 20 is disposed at a position at which its front portion overlaps the third container transport device 16.

The label fitting unit 20 includes a plurality of mandrel heads 40 for fitting tubular labels L on the outer peripheries of the pot portions P of the container packs CP4 that are transported by the third container transport device 16 in a suspended manner, and a mandrel movement device 42 for circulating the mandrel heads 40 along an approximately track-like movement trajectory.

The mandrel movement device 42 includes a drive pulley 44 and a follower pulley 46 that are spaced apart from each other by a predetermined interval, and an endless belt 48 that is looped over the pulleys 44 and 46. The drive pulley 44 is connected so as to be driven to rotate by a motor 49. The plurality of mandrel heads 40 described above are attached to an outer circumferential surface of the belt 48 with a predetermined pitch. With the above-described configuration, as the drive pulley 44 is driven to rotate by the motor 49, the belt 48 rotates in the arrow direction. As a result, the plurality of mandrel heads 40 attached to the belt 48 circulate along a track-like or loop-like circulation path. More specifically, the mandrel heads 40 are configured to move through a linear section 47 in the front portion of the label fitting unit 20. As the linear segment movement path of the mandrel heads 40 is located directly below the third container transport device 16, the mandrel heads 40 can fit labels on the outer peripheries of the pot portions P of the containers C at a label fitting position β while being translated in synchronization with the container packs CP4 that are transported in a suspended manner by the third container transport device 16.

The label fitting unit 20 is also provided with a label forming unit 50. The label forming unit 50 has the function of forming tubular labels L by cutting a long sheet of label material into predetermined lengths and passing them by fitting them on the outer peripheries of mandrels of the mandrel heads 40 with the labels L in an open state.

In the illustrated embodiment, the label forming unit 50 is disposed to pass the labels to the mandrel heads 40 at a label supply position α that is on a circular movement trajectory before the mandrel heads 40 go around the follower pulley 46 and reach the linear section 47. This configuration has an advantage in that, because a relatively large clearance is formed between the mandrel heads 40 in a region in which the mandrel heads 40 circularly move as described above, the operation of supplying labels to the mandrel heads 40 can be performed reliably without any interference between the mandrel heads 40. However, the present invention is not limited to this embodiment; the label forming unit 50 may be disposed in a different region of the label fitting unit 20 (for example, in the back region of the label fitting unit 20).

As described above, in the illustrated embodiment, the label forming unit 50 is disposed to form labels and pass the labels to the mandrel heads 40 at a position that is deviated from the container transport path of the third container transport device 16 in the label fitting system 10 as viewed from above. This configuration allows continuing the label supply operation of the label forming unit 50 without any interruption even when contents contained in the containers C of the container packs CP4 spill down due to a certain trouble at the label fitting position β, because the label forming unit 50 including a cutting unit is not present below the spilling contents. Therefore, the capacity utilization of the label fitting system 10 is increased, and the productivity can be improved.

The circulation path of the mandrel movement device 42 along which the plurality of mandrel heads 40 circulate extends from a position that overlaps the label fitting position β of the linear container transport path in the third container transport device 16 to go around the back side of the container transport path and pass through the label supply position α to go back to the label fitting position β. This configuration has an advantage in that, because the circulation path of the mandrel heads 40 is disposed only on the back side of the label fitting system 10 as described above, the front side of the label fitting position β can be used as an operation space for the operator OP, and the ease of operation is improved.

Further, the label fitting system 10 of the illustrated embodiment can be incorporated in a production apparatus that performs a series of process including the steps of forming containers, filling the containers with contents, hermetically sealing the containers with lids, and separating the containers into individual containers or into container packs each including a predetermined number of containers. Labels having a trade name or other information printed thereon can be attached to the outer peripheries of the pot portions of the containers of the container packs.

The label fitting unit 20 may also be provided with a cleaning station 200 and a drying station 300. These stations 200 and 300 will be described later.

Figure 4:
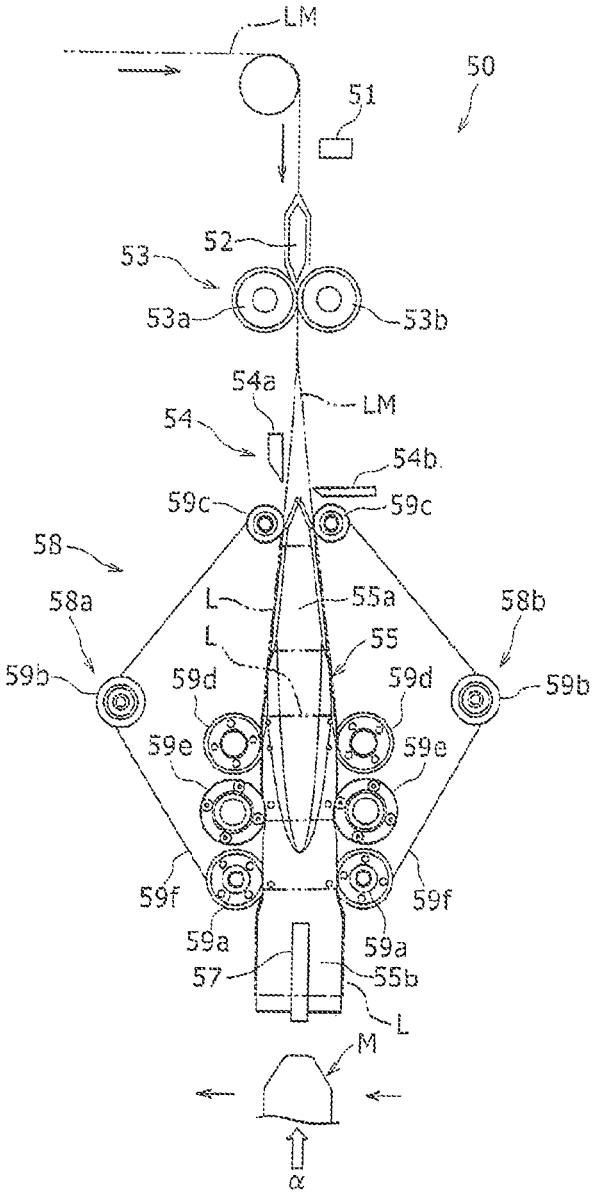
FIG. 4 is a front view of a label forming unit.
Figure 5:
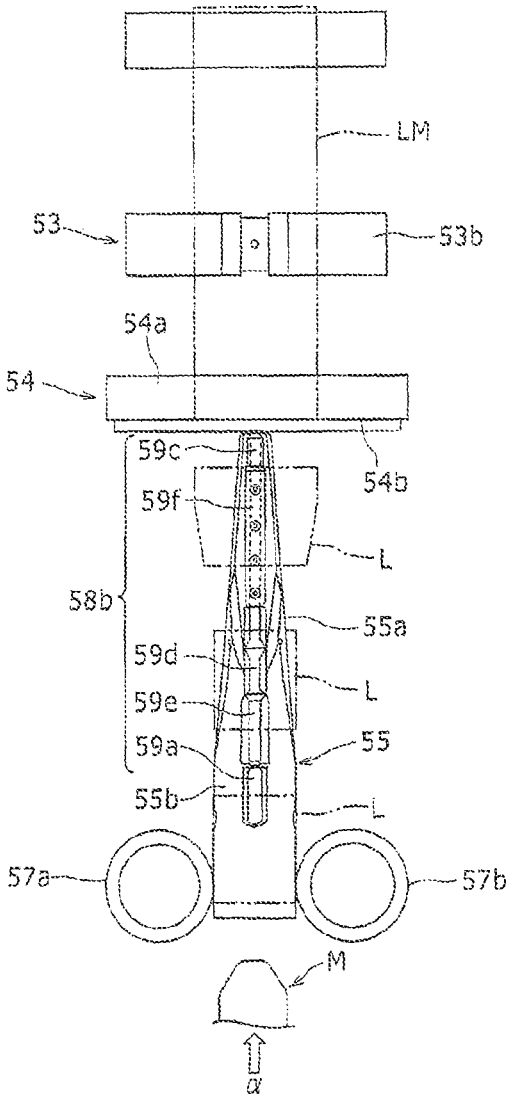
FIG. 5 is a side view of the label forming unit.

FIG. 4 is a front view of the label forming unit 50 that is provided in the label fitting unit 20, and FIG. 5 is a side view of the label forming unit 50. In FIGS. 4 and 5, label material LM and labels L that are formed by cutting the label material LM are illustrated by chain double-dashed lines.

As illustrated in FIGS. 4 and 5, the label forming unit 50 is configured to, while separating the individual labels L from the label material LM that is composed of a continuous tubular label L that is flattened in a sheet, sequentially release the labels L at the label supply position α so that the labels L are passed to mandrels M of the mandrel heads 40 that are sequentially transferred by the mandrel movement device 42.

The label forming unit 50 includes a mark sensor 51, an inner guide 52, a pitch feeding roller pair 53, a cutting unit 54, a label shaping guide component 55, a pair of shot rollers 57*a* and 57*b*, and a transfer unit 58 which are disposed, in that order, from above.

The mark sensor 51 detects a cut mark that is printed or otherwise formed on the label material LM. The operation of, for example, the pitch feeding roller pair 53 or the cutting unit 54, which will be described later, is controlled based on a mark detection signal output from the mark sensor 51.

The inner guide 52 is disposed below the mark sensor 51 and is placed inside the tubular label material LM that is in continuous form and is transported continuously. The inner guide 52 serves to release an intimate contact state of the label material LM and guide the label material LM to vertically enter the pitch feeding roller pair 53.

The pitch feeding roller pair 53 is composed of a pair of rollers: a drive roller 53*a* and a follower roller 53*b* for intermittently feeding the label material LM with a predetermined pitch toward the cutting position. The drive roller 53*a* is driven to rotate by a motor such as a servomotor or a stepping motor, which is not illustrated. This motor is intermittently driven and controlled based on the mark detection signal output from the mark sensor 51, to feed the label material LM downward in units of predetermined cut lengths from between the rollers 53*a* and 53*b* of the pitch feeding roller pair 53.

The cutting unit 54 is a cutter including a fixed blade 54*a* and a movable blade 54*b* for sequentially cutting the label material LM that is fed downward in units of predetermined lengths from the pitch feeding roller pair 53 to form individual labels L. The movable blade 54*b* is driven to reciprocate by a motor such as a servomotor or a stepping motor, which is not illustrated, and is controlled based on the mark detection signal output from the mark sensor 51, to operate to cut a label L from the label material LM during a pause of the feeding operation of the label material LM by the pitch feeding roller pair 53. The cutting unit 54 may be composed of a fixed blade and a rotary movable blade.

The label shaping guide component 55 brings the label material LM fed by the pitch feeding roller pair 53 into a predetermined open state by fitting the label material LM thereon, and serves as a guide component during the downward transport of the labels L cut from the label material LM by the transport function of the transfer unit 58.

The label shaping guide component 55 has a label opening portion 55*a* having a tapered wedge-shaped upper end, and a label shaping portion 55*b* having a circular cross section that is disposed below and contiguous to the label opening portion 55*a*. The label material LM fitted on the upper end of the label opening portion 55*a* is gradually brought into an open state as it is transferred downward below the label opening portion after it is separated into individual labels L, and is shaped into a tubular open state as it is fitted on the label shaping portion 55*b*. The pair of shot rollers 57*a* and 57*b* are rotatably attached to a lower end of the label shaping portion 55*b* of the label shaping guide component 55.

The transfer unit 58 is composed of feed belt units 58*a* and 58*b* that are configured to nip a label L separated from the label material LM by the cutting unit 54 in a state in which it is fitted on the label opening portion 55*a* of the label shaping guide component 55, between the transfer unit 58 and the label opening portion 55*a*, to transfer the label L to the label shaping portion 55*b*. Each of the feed belt units 58*a* and 58*b* is composed of a drive pulley 59*a*, four follower pulleys 59*b*, 59*c*, 59*d*, and 59*e*, and an endless feed belt 59*f* having a narrow width (a width of, for example, on the order of a few millimeters) that is looped over the pulleys 59*a*, 59*b*, 59*c*, 59*d*, and 59*e*. The feed belt 59*f* is configured to transfer the label L to the lower end of the label shaping guide component 55 while shaping the label L in an open state as the feed belt 59*f* is driven to rotate in the axial direction on both sides of the label shaping guide component 55.

The pair of shot rollers 57*a* and 57*b* are disposed on the lower end of the label shaping guide component 55 at positions that are opposite to each other in the radial direction. Each of the shot rollers 57*a* and 57*b* is directly connected to a rotating shaft of a motor, which is not illustrated. This configuration allows a label L fitted on the label shaping guide component 55 to be fed downward along the outer circumferential surface of the label shaping portion 55*b* as the shot rollers 57*a* and 57*b* are driven to rotate, to be fitted onto a mandrel M of a mandrel head 40.

Figure 6:
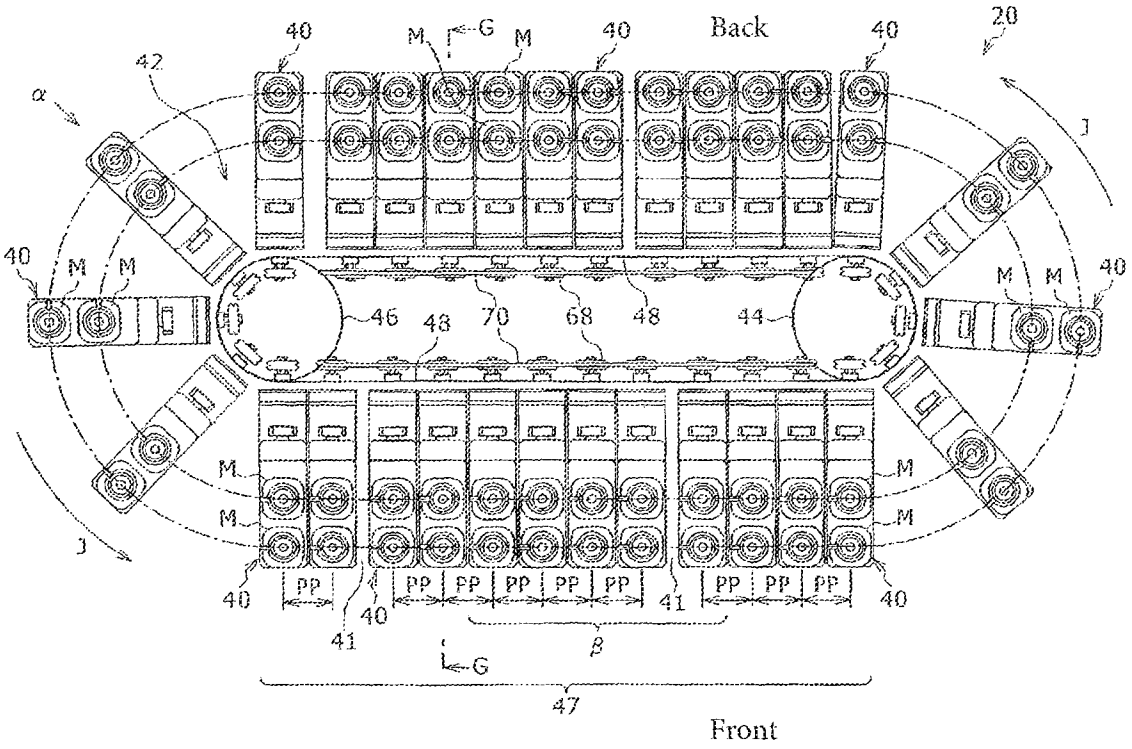
FIG. 6 illustrates only mandrel heads of a label fitting unit as viewed from above.
Figure 7:
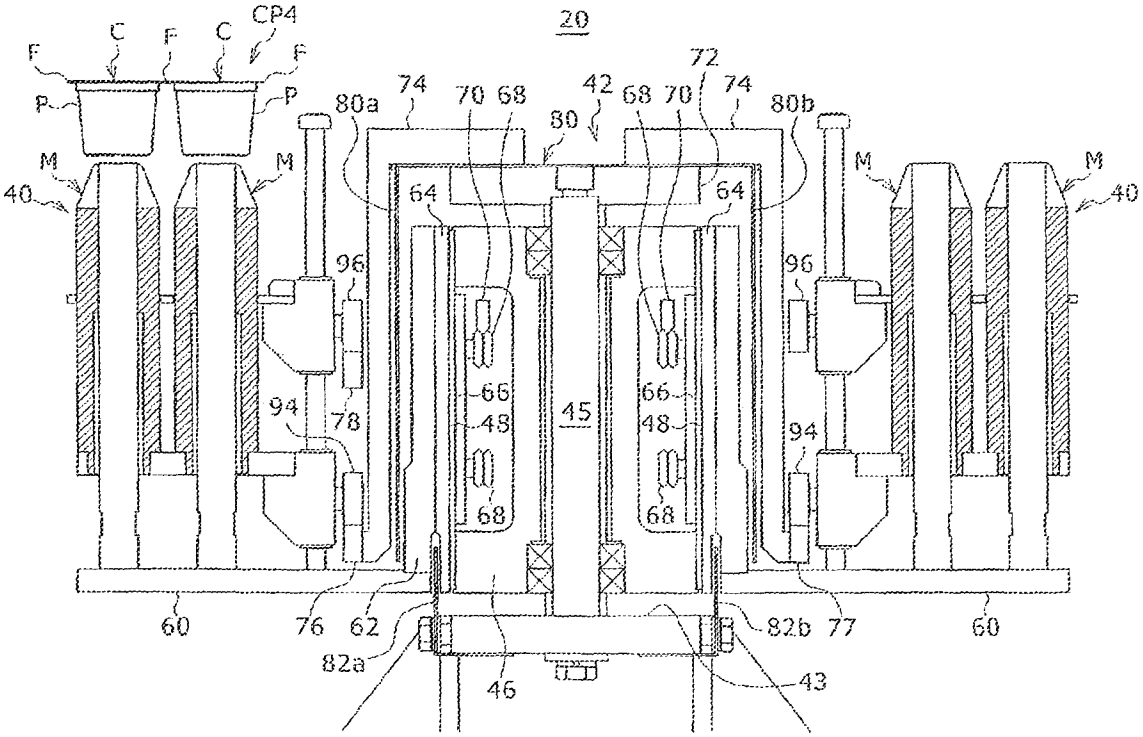
FIG. 7 is a cross-sectional view taken along line G-G in FIG. 6.

Next, the label fitting unit 20 of the illustrated embodiment will be described in more detail below with reference to FIGS. 6 and 7. FIG. 6 illustrates only the mandrel heads 40 of the label fitting unit 20 as viewed from above. FIG. 7 is a cross-sectional view taken along line G-G in FIG. 6.

As illustrated in FIG. 6, and as described above, the plurality of mandrel heads 40 of the label fitting unit 20 are configured to circulate along the track-like movement path in the counterclockwise direction (the direction of arrows J) as the belt 48 looped over the drive pulley 44 and the follower pulley 46 is moved to rotate.

Each of the mandrel heads 40 of the illustrated embodiment includes two mandrels M that are disposed side by side, to conform to the above-described configuration in which the first, second, and third container transport devices 12, 14, and 16 transport the container packs CP4 in a manner such that the containers C are arranged in two rows in the direction perpendicular to the container transport direction A. Such mandrel heads 40 are configured to move in the linear section 47 of the mandrel movement device 42 in groups of six mandrel heads 40 including twelve mandrels M aligned with a predetermined pitch PP. The predetermined pitch PP is the same as the pot pitch between the pot portions P of the containers C that are integrally included in a container pack CP4 and the transport pitch PP between two adjacent pot portions P of the container packs CP4 for which pitch-feeding is performed by the second container transport device 14. In the illustrated embodiment, while the six mandrel heads 40 aligned as described above are moving in the linear section 47 as a group aligned with the predetermined pitch PP, tubular labels L lifted from the mandrels M are fitted from below the container packs on the pot portions P of the container packs CP4 that are transported above the mandrel heads 40 in synchronization with the mandrel heads 40 by the third container transport device 16.

The mandrel heads 40 are attached to the belt 48 on the inner side of the loop-like circulation path with the predetermined pitch PP as described above. However, clearances 41 are formed upstream and downstream of a group of six mandrel heads 40 in the movement direction in the linear section 47 between this group of mandrel heads 40 and other groups of mandrel heads 40. The clearances 41 are formed to be greater than clearances between the six mandrel heads 40 in a group. Such clearances 41 allow use of the same mandrel movement device 42 even when the mandrel heads 40 need to be replaced in order to fit labels on container packs of a different shape and size.

As illustrated in FIG. 7, the label fitting operation is performed while the mandrel heads 40 are being translated with two mandrels M included therein kept opposed to the bottoms of two pot portions P aligned in a container pack CP4 that is transported in a suspended manner by the third container transport device 16, in a non-contact state with a clearance (a clearance of, for example, on the order of a few to ten millimeters) between the two mandrels M and the two pot portions P. During the label fitting operation, the container packs CP4 and the mandrels M linearly move in the horizontal direction without any vertical movement. As such, the label fitting operation of fitting labels on the pot portions P of the container packs CP4 can be performed stably even when the container transport speed is increased. As the label fitting operation is performed with the upper ends of the mandrels M kept out of contact with the bottoms of the pot portions P, the pot portions P of the containers C included in the container packs CP4 will not be damaged.

The label fitting unit 20 of the illustrated embodiment has a configuration in which six mandrel heads 40 including twelve mandrels M move in the linear section 47 as a group in which they are aligned with the predetermined pitch PP. With this configuration in which six mandrel heads 40 including twelve mandrels M, which is the least common multiple of two pots, four pots, and six pots, move as a group, the label fitting unit 20 can be used not only for 4-pot packs CP4 as described with reference to the illustrated embodiment, but also for 2-pot packs CP2 having two containers C integrally connected via flange portions F in units of two rows by one set (see FIG. 3(*b*)) or for 6-pot packs CP6 having six containers C integrally connected via flange portions F in units of two rows by three sets (see FIG. 3(*c*)) without changing parts (or without changing dies).

More specifically, for 2-pot packs CP2, six 2-pot packs CP2 including a total of twelve containers C are pitch-fed by the second container transport device 14 with the predetermined pitch PP, and then passed to the third container transport device 16 and transported in a suspended manner to the label fitting position β. For 4-pot packs CP4, three 4-pot packs CP4 including a total of twelve containers C are pitch-fed by the second container transport device 14 with the predetermined pitch PP, and then passed to the third container transport device 16 and transported in a suspended manner to the label fitting position β. For 6-pot packs CP6, two 6-pot packs CP6 including a total of twelve containers C are pitch-fed by the second container transport device 14 with the predetermined pitch PP, and then passed to the third container transport device 16 and transported in a suspended manner to the label fitting position β. The label fitting unit 20 of the illustrated embodiment can fit labels on any of 2-pot packs CP2, 4-pot packs CP4, and 6-pot packs CP6 in this manner. Therefore, the flexibility in use of the label fitting system 10 is improved, and the equipment costs can be reduced.

In the above-described embodiment, the clearances 41 are formed in front of and behind a group of six mandrel heads 40 in the transport direction. To provide corresponding clearances between the container packs that are transported by the third container transport device 16, for example, the transport speed of the second container transport device 14 (in other words, the speed at which the moving tabs 24 are moved by the motor 30) may be reduced or otherwise controlled at the time when the container packs are passed from the second container transport device 14 to the third container transport device 16.

However, if only container packs each integrally including a specific number of containers C, such as 4-pot packs, are to be considered, it is unnecessary to provide the clearances 41 as described above; all mandrel heads 40 may be attached to the belt 48 with a constant pitch, for example, corresponding to the predetermined pitch. Even in that case, the system can be flexibly used for 2-pot packs CP2, 4-pot packs CP4, and 6-pot packs CP6 as in the above-described embodiment.

Next, the mandrel movement device 42 of the label fitting unit 20 will be described in detail below with reference to FIG. 7. Two mandrels M of each mandrel head 40 are supported in a state in which the lower ends of the mandrels M are vertically disposed on a base plate 60 that is made of, for example, a metal. A bracket 62 is fixed to an inner circumferential end of the base plate 60 by a fixing means such as a bolt. The bracket 62 is attached to the belt 48 with an outer side attachment component 64 being interposed therebetween, by a fixing means such as a bolt and a nut. An inner side attachment component 66 is disposed on the inside of the belt 48, and the mandrel heads 40 are fixed to the belt 48 by a fixing means such as a bolt and a nut with the belt 48 being sandwiched between the above-described outer side attachment component 64 and the inner side attachment component 66. As described above, the mandrel heads 40 are attached to the belt 48 in a cantilevered state.

Two rollers 68 are rotatably attached to the inner side attachment component 66 at positions that are apart from each other by a predetermined distance in the vertical direction. The upper roller 68 of these rollers 68 is in abutment with a lower surface of a rail component 70 that is fixed at a predetermined position in the mandrel movement device 42. As such, the weight of the mandrel heads 40 that circulate along with the belt 48 in a cantilevered state is supported by the rollers 68 and the rail component 70.

The belt 48 is looped over the drive pulley 44 and the follower pulley 46 as described above, and circulates as the drive pulley 44 is driven to rotate by the motor 49 (see FIG. 2). Each of the pulleys 44 and 46 is rotatably supported by a shaft 45 that is vertically disposed on a base frame 43 of the mandrel movement device 42. FIG. 7 simply illustrates the follower pulley 46, and the shaft 45 that supports the follower pulley 46.

The mandrel movement device 42 has a top cover 80 having a rectangular cross section with one side open. The top cover 80 is fixed to a frame 72 that is fixed to an upper end of the shaft 45 that is vertically disposed on the base frame 43, by a fixing means such as a screw. The top cover 80 has a front wall 80*a* and a back wall 80*b*, each of which hangs down from above on the outer side of the brackets 62 of the mandrel heads 40 and has a lower end extending to a position that is close to upper surfaces of the base plates 60.

On the other hand, a front lower cover 82*a* and a back lower cover 82*b* are attached to the base frame 43. Each of the front lower cover 82*a* and the back lower cover 82*b* extends upward in a clearance that is formed in a lower area between the bracket 62 of the mandrel head 40 and the outer side attachment component 64, and has an upper end that is located above the lower ends of the front and back walls 80*a* and 80*b* of the top cover 80.

The above-described coverage by the top cover 80 and the front and back lower covers 82*a* and 82*b* enables reliable prevention of entrance of a cleaning liquid into the mandrel movement device 42 when the mandrel heads 40 are washed, which will be described later.

A fixing component 74 having an L-shaped cross section or side surface is attached to a top plate portion of the top cover 80 on each of the front side and the back side of the mandrel movement device 42. A first cam plate 76 and a second cam plate 78 are fixed to the front of the mandrel movement device 42 by the fixing component 74. The first cam plate 76 and a first cam follower 94 of the mandrel head, which will be described later, together constitute a first cam mechanism. The second cam plate 78 and a second cam follower 96 of the mandrel head 40, which will be described later, together constitute a second cam mechanism.

On the other hand, a supporting plate 77 is fixed to the back of the mandrel movement device 42 by the fixing component 74. The supporting plate 77 has an upper surface that extends in the horizontal direction, and the first cam follower 94 of the mandrel head 40 is in abutment with this upper surface. The weight of structural components (including label feeding guides, lifting plates, and first and second connecting components) of the mandrels M included in the mandrel head 40 are supported in this manner.

Although in an example in the foregoing description, the belt 48 is used as a movement component for causing the mandrel heads 40 to circulate, the present invention is not limited to this example. For example, a plurality of chains may be configured to circulate by a plurality of sprockets, and the mandrel heads 40 may be connected to these chains.

Although in an example in the foregoing description, the mandrel heads 40 circulate in a cantilevered state, wheels may be attached to the base plates 60 of the mandrel heads 40, and the mandrel heads may be configured to circulate in a state in which the wheels sit in a rail that is fixed to the base frame 43. This configuration allows more stable support of the mandrel heads.

Figure 8:
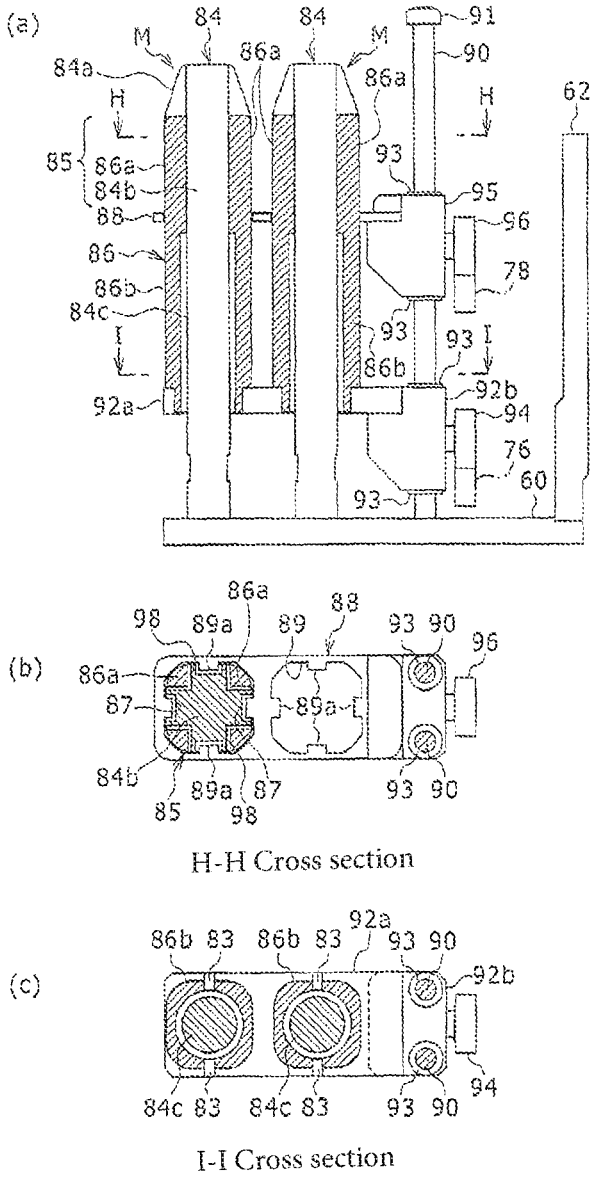
FIG. 8(*a*) is a front view of mandrel heads, partially in cross section, FIG. 8(*b*) is a cross-sectional view taken along line H-H in FIG. 8(*a*), and FIG. 8(*c*) is a cross-sectional view taken along line I-I in FIG. 8(*a*).

Next, the structure and operation of the mandrel heads 40 will be described in more detail below with reference to FIGS. 8 to 12. FIG. 8(*a*) is a front view of a mandrel head 40, partially in cross section. FIG. 8(*b*) is a cross-sectional view taken along line H-H in FIG. 8(*a*). FIG. 8(*c*) is a cross-sectional view taken along line I-I in FIG. 8(*a*).

As illustrated in FIG. 8(*a*), the mandrel head 40 includes two mandrels M, a base plate 60 that supports lower ends of the mandrels M, and a bracket 62 that is fixed to an inner circumferential end of the base plate 60 (on the right side in FIG. 8(*a*)) and that extends upward in parallel to the mandrels M. The mandrels M are vertically disposed on the base plate 60 with a pitch that is equal to that of two pot portions P adjacent to each other in a direction perpendicular to the container transport direction A (see FIGS. 1 and 2).

It is preferred that the base plate 60 of the mandrel head 40 is composed of a lightweight and anticorrosive metal plate. Specifically, for example, an aluminum plate may be used as the base plate 60. However, the present invention is not limited to this example; a flat plate that is made of a lightweight and anticorrosive resin may also be used as the base plate 60.

Each of the mandrels M includes a mandrel shaft 84 that has a lower end fixed to the base plate 60 and that extends upward, a label feeding guide 86 that is disposed external to the periphery of the mandrel shaft 84 to be movable in the shaft axial direction (the vertical direction in the illustrated embodiment), and a lifting plate (lifting member) 88 that is disposed external to the periphery of the label feeding guide 86 to be movable in the shaft axial direction.

The mandrel shaft 84 is composed of a rod component that is made of, for example, a resin. In the illustrated embodiment, the mandrel shaft 84 has a tip portion that is formed approximately like a frustum of a rectangular pyramid. Such a tapered tip portion 84*a* allows easy receipt of labels L that are supplied downward from the label forming unit 50 in an open state.

The mandrel M includes a label holding portion (a film holding portion) 85 disposed below the tip portion 84*a* of the mandrel shaft 84. The label holding portion 85 serves as an outer peripheral surface of the mandrel M. The labels L fitted onto the mandrel M are held on the outer peripheral surface during movement of the mandrel head 40 from the label supply position α to the label fitting position β. The label holding portion 85 is positioned above a label lifting plate 88 disposed in a standby position.

The mandrel shaft 84 includes an intermediate shaft portion 84*b* continuously extending downward from the tip portion 84*a*. As illustrated in FIG. 8(*b*), the intermediate shaft portion 84*b* of the mandrel shaft 84 has an approximately square cross-section, and also has four corners. A guide groove 98, which is formed by cutting the corner in the shape of V, is formed to extend in the shaft axial direction on each of the four corners.

A guide bar 86*a* serving as a part of the label feeding guide 86 is fitted into each guide groove 98 of the intermediate shaft portion 84*b* of the mandrel shaft 84. The guide bar 86*a* of the label feeding guide 86 has a fan-shaped cross-section having an approximately right-angled center, and includes an arc-shaped external surface serving as a part of a surface of the label holding portion 85. An external surface which is an outer periphery of the intermediate shaft portion 84*b* of the mandrel shaft 84 also serves as a part of the surface of the label holding portion.

Four engagement grooves 87 are formed so as to extend in the shaft axial direction. Each of the engagement grooves 87 is formed on a center position of an associated side of the intermediate shaft portion 84*b*, which is approximately square, of the mandrel shaft 84. A projecting portion 89*a* of the lifting plate 88 described later is fitted into each engagement groove 87 so as to be movable in the vertical direction.

As illustrated in FIG. 8(*c*), a lower side shaft portion 84*c* continuous with the intermediate shaft portion 84*b* of the mandrel shaft 84 is formed as a round rod shaft portion having a circular cross-section. The guide grooves 98 and the engagement grooves 87 are formed to extend from the intermediate shaft portion 84*b* to the tip portion 84*a* of the mandrel shaft 84, but not formed on the lower side shaft portion 84*c*.

The label feeding guide 86 of each of the mandrels M is composed of a tubular component made of the same resin material as the mandrel shaft 84. As illustrated in FIGS. 8(*a*) and 8(*c*), a lower portion 86*b* of the label feeding guide 86 has an approximately square outline with rounded corners similar to that of the label holding portion 85 of the mandrel M. The lower portion 86*b* of the label feeding guide 86 is tubular with a cylindrical cavity formed therein. In contrast, an upper portion of the label feeding guide 86 is composed of four guide bars 86*a* corresponding to the guide grooves 98 of the mandrel shaft 84. Each of these guide bars 86*a* is disposed in a corresponding one of the guide grooves 98 of the mandrel shaft 84 so as to be movable in the vertical direction. It is preferred that the curved outer surfaces of the guide bars 86*a* are formed to be approximately flush with the outer circumferential surface of the intermediate shaft portion 84*b* of the mandrel shaft 84. This configuration allows labels L to be received and fed along the mandrel M smoothly without being hooked.

As illustrated in FIGS. 8(*b*) and 8(*c*), the lifting plate 88 for the mandrels M is a flat plate component that is made of, for example, a resin and has two through holes 89 that can receive two mandrels M. Each of the through holes 89 is formed approximately in a square shape that is slightly larger than the outline of the intermediate shaft portion 84*b* of the mandrel shaft 84 and the outline of the label holding portion 85 configured to include the guide bar 86*a* of the label feeding guide 86. The through hole 89 is provided with four projecting portions 89*a*, each projecting toward the center portion of the through hole 89 from the center position of a corresponding one of the sides of the through hole 89. Each of the projecting portions 89*a* is disposed so as to be movable in the vertical direction while being engaged in a corresponding one of the engagement grooves 87 that are formed in the intermediate shaft portion 84*b* of the mandrel shaft 84.

Lower ends of the label feeding guides 86 of two mandrels M included in each of the mandrel heads 40 are fixed to a connecting plate 92*a* that is made of, for example, a resin. One end of the connecting plate 92*a* is fixed to a first connecting component 92*b* by a fixing means such as a bolt. Two guide components 90 are vertically disposed on the base plate 60 in parallel to the mandrels M. A stopper 91 is fixed to an upper end of each of the guide components 90. In this structure, it is preferred that each of the guide components 90 is composed of a round rod component that is made of, for example, an anticorrosive metal. Specifically, round rods that are made of, for example, stainless steel may be suitably used as the guide components 90.

The first connecting component 92*b* described above is supported so as to be slidable along the guide components 90 via bushings 93 that are made of, for example, a resin. A first cam follower 94 is rotatably attached to a side of the first connecting component 92*b*. The first cam follower 94 is in abutment with the first cam plate 76 of the mandrel movement device 42. The first cam follower 94 and the first cam plate 76 together constitute a first cam mechanism that causes the label feeding guide 86 of each of the mandrels M to move in the vertical direction.

One end of the lifting plate 88 of the mandrel head 40 is fixed to a second connecting component 95 by a fixing means such as a bolt. Similarly as for the first connecting component 92*b*, the second connecting component 95 is supported so as to be slidable along the guide components 90 via bushings 93 that are made of, for example, a resin. A second cam follower 96 is rotatably attached to a side of the second connecting component 95. The second cam follower 96 is in abutment with the second cam plate 78 of the mandrel movement device 42. The second cam follower 96 and the second cam plate 78 together constitute a second cam mechanism that causes the lifting plate 88 of the mandrel head 40 to move in the vertical direction.

Figure 9:
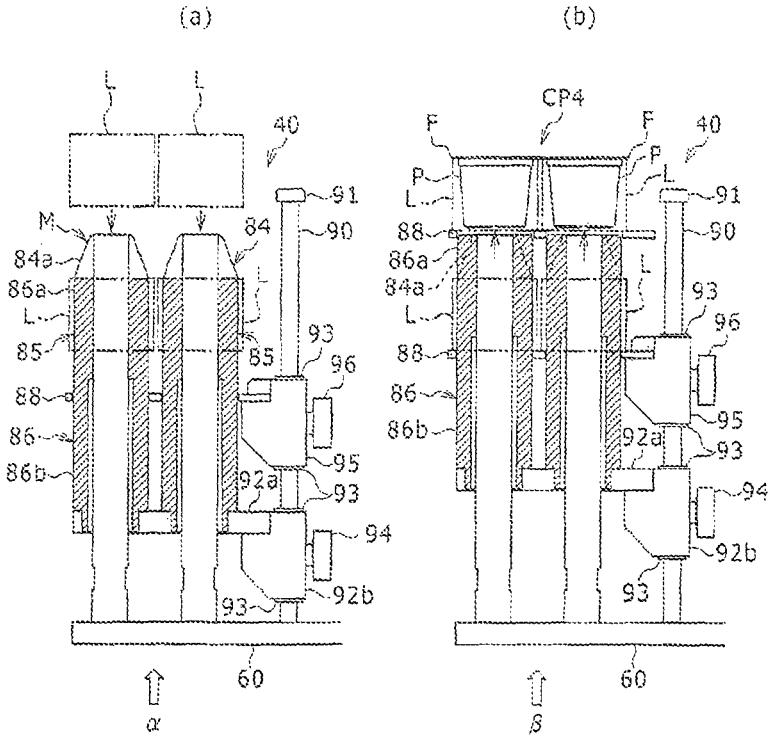
FIG. 9(*a*) is a front view illustrating a state of the mandrel heads at a label supply position, and FIG. 9(*b*) is a front view illustrating a state of the mandrel heads at a label fitting position.

FIG. 9(*a*) is a front view illustrating a state of the mandrel head 40 at the label supply position α, and FIG. 9(*b*) is a front view illustrating a state of the mandrel head 40 at the label fitting position β.

As illustrated in FIG. 9(*a*), while the mandrel head 40 is passing through the label supply position α by the action of the mandrel movement device 42, tubular labels that are in an open state are supplied from the label forming unit 50 disposed above the label supply position α. At this time, the label feeding guide 86 of each of the mandrels M of the mandrel head 40 is at a label receiving position (a film receiving position) at which the label feeding guide 86 has moved down with respect to the mandrel shaft 84. In this state, the guide bars 86*a* of the label feeding guide 86 are located below a tapered tip portion 84*a* of the mandrel shaft 84 so as to be received in the guide grooves 98. As such, the mandrel head 40 can smoothly and reliably receive tubular labels L on the outer peripheries of the mandrels M via the tapered tip portion 84*a*.

In contrast, at the label fitting position β, as illustrated in FIG. 9(*b*), the driving of the first cam mechanisms 76, 94 causes the label feeding guide 86 to move up to a predetermined height to reach a label feeding position (a film feeding position). At the label feeding position, the upper ends of the guide bars 86*a* of the label feeding guide 86 are placed to project around the tapered tip portion 84*a* of the mandrel shaft 84, so that labels L can be fed in an open state to be approximately of the same size as the outer circumferential shape of the pot portions P of the containers C.

In this state, the driving of the second cam mechanisms 78, 96 causes the lifting plate 88 to move up from the standby position shown in FIG. 9(*a*) to the label lifting position shown in FIG. 9(*b*). The projecting portions 89*a* of the lifting plate 88 correspondingly move up along the engagement grooves 87 of the engagement grooves 84*b* of the mandrel shaft 84. As a result, the projecting portions 89*a* of the lifting plate 88 come into abutment with the lower edge of the label L fitted on the label holding portion 85 of the mandrel shaft 84 to lift and fit the label L from the mandrel M onto the outer periphery of the pot portion P of the container C from below the container.

Figure 10:
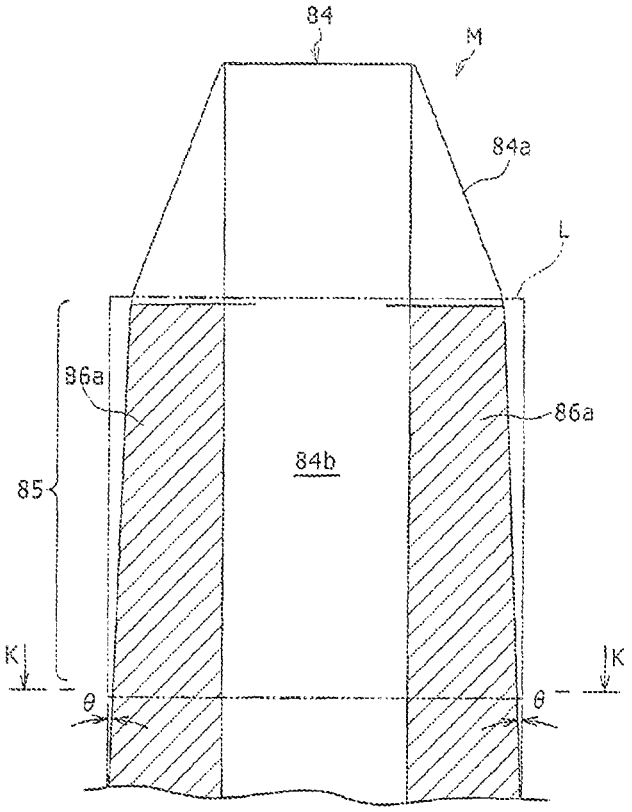
FIG. 10 is an enlarged view of a label holding portion provided in an upper portion of the mandrel.
Figure 11:
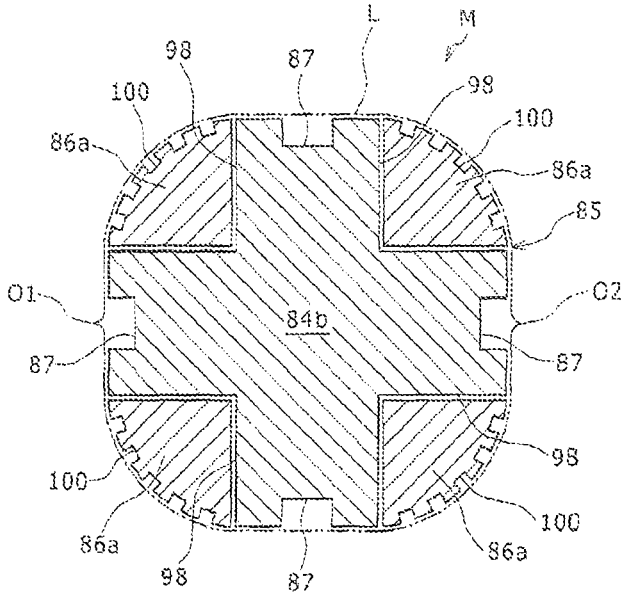
FIG. 11 is a cross-sectional view taken along line K-K in FIG. 10.

FIG. 10 is an enlarged view of the label holding portion 85 provided in the upper portion of the mandrel M. FIG. 11 is a cross-sectional view taken along line K-K in FIG. 10. In FIG. 10, the line K-K corresponds to the lower end position of the label holding portion 85. FIG. 11 illustrates folds O1, O2 left on the label L that is cut and formed from the label material LM folded into a sheet.

The label holding portion 85 of the mandrel M has a tapered surface that is tapered down toward the top. As illustrated in FIG. 11, the tapered surface is composed of externally exposed surfaces of the intermediate shaft 84*b* of the mandrel shaft 84, and externally directed surfaces of the four guide bars 86*a* of the label feeding guides 86 facing outside.

The angle θ of the tapered surface of the label holding portion 85 with respect to the axial direction of the mandrel M is, e.g., 2° to 10°, and more preferably 4° to 8°. If the angle θ is smaller than the above angle range, the contact resistance between the inner surface of the label L and the mandrel M increases at the time of receiving and feeding the Label L. Accordingly, the label L has a difficulty when moving along the outer peripheral surface of the mandrel M. If the angle θ is larger than the above angle range, the clearance increases between the upper inner surface of the label L fitted onto the label holding portion 85 and the surface of the label holding portion 85. Accordingly, the label L is held in an unstable state. Then, the label L is likely to rotate and be displaced laterally on the outer peripheral surface of the mandrel M.

An outer peripheral length of the lower end 85*a* of the label holding portion 85 is set to be approximately equal to a peripheral length of the label L in an open state. Accordingly, the Label L fitted onto the mandrel M has a lower edge that is in contact with and held on the outer peripheral surface of the lower end 85*a* of the label holding portion 85. Thus, the holding position of the label L on the mandrel M becomes stable. Then, the fitting operation of fitting the label L having been subsequently fed from the mandrel M onto the pot portion of the pot can be suitably conducted. As a result, the fitting failure of the label L can be reduced.

Moreover, it is preferred that the label holding portion 85 is formed as a tapered surface extending with a length equal to or longer than the label L. The label holding portion 85 having a length equal to or longer than the label as described above allows a clearance between the label L and the label holding portion 85 to decrease over the entire length of the label L. This is advantageous in holding the label L in a stable state. The label holding portion 85 including such a tapered surface also causes only the holding position to be slightly high even when the label L has a slightly small diameter due to natural shrinkage or a manufacturing tolerance. Thus, the label L is fitted and fed without any difficulty. That is, this embodiment can adequately cope with the natural shrinkage and manufacturing tolerance of the label L. In addition, when a small change in the folding diameter of the label L is made, the same mandrel M still can be used.

The label holding portion 85 of this embodiment is composed of the tapered surface having a flat surface and extending with a length longer than the label L, but the present invention is not limited by this embodiment. The axial length of the label holding portion 85 may be shorter than the label L. The angle of the tapered surface may be varied at some midpoint thereof.

As illustrated in FIG. 11, in the mandrel M of this embodiment, the guide bars 86*a* each serving as a guide for feeding the label L held on the label holding portion 85 to the pot portion P of the container C are arranged in four corners corresponding to corner portions of the intermediate shaft 84*b* of the mandrel shaft 84. The guide bars 86*a* thus arranged correspond to the respective corners of the pot portion P having an approximately rectangular shape with rounded corner portions. Thus, the label L can be fed in a state in which the label L is shaped into an open state in which the label L has an approximately rectangular shape with rounded corners corresponding to the outer periphery of the upper end of the pot portion P, which is a fitting target. As a result, the fitting operation of the label L can be reliably conducted more reliably. During the fitting operation, the label L can be effectively prevented from rotating in the peripheral direction. Thus, a symbol such as letters, marks, or similar markings indicated on the label L can be put onto the pot P toward a front side desired, e.g., a X side in FIG. 11.

As illustrated in FIG. 11, at least one groove 100 is formed on the external surface of each of the guide bars 86*a* of the label feeding guide 86 in the axial direction of the mandrel shaft 84 (i.e., the mandrel M). This groove 100 allows a contact area between the external surface of the guide bar 86*a* and the inner surface of the label L to decrease at the time of receiving and feeding the label L. As a result, the contact resistance decreases, and a feed operation of the label L can be smoothly conducted. When the mandrel head 40 is washed with water or similar in the cleaning station 200 (see FIG. 2) described later, the water on the mandrel M tends to be accumulated in the groove 100 of the guide bar 86*a* due to the surface tension of the water. Thus, even if the label L is fitted before the mandrel M is completely dried, the water prevents the label L from adhering to the external surface of the guide bar 86*a*. This is useful in smoothly conducting a fitting operation and a feed operation of the label L.

Note that the number of grooves 100 formed on the guide bar 86*a* or the cross-sectional shape of the groove 100 can be changed as appropriate. As long as the drying station 300 completely conducts a drying operation, the guide bar 86*a* may be provided without the groove 100. Moreover, instead of the groove 100, the guide bar 86*a* may have a rough external surface. The guide bar 86*a* may also be coated to have a reduced contact resistance against the label L.

Figure 12:
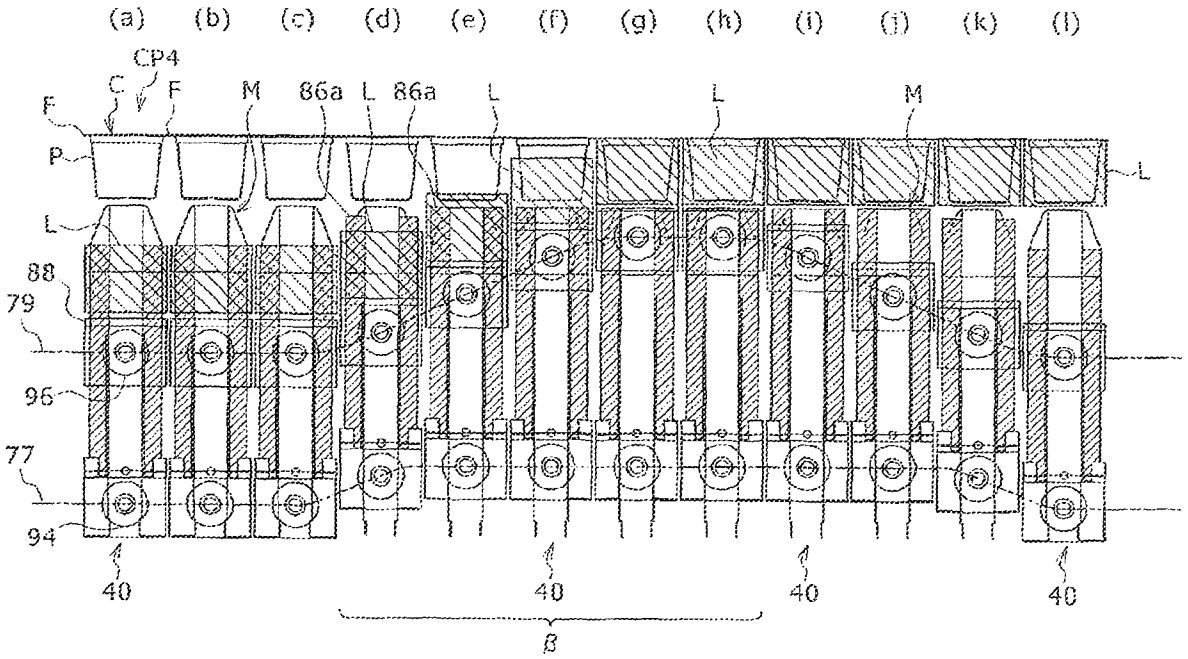
FIGS. 12(*a*) through 12(*l*) sequentially illustrate a label fitting operation of the mandrel heads.

Next, a label fitting operation of the mandrel head 40 of this embodiment will be described with reference to FIG. 12. FIGS. 12(*a*) through 12(*l*) sequentially illustrate the label fitting operation of the mandrel head 40. The label fitting operation of the mandrel M proceeds from left to right in FIGS. 12(*a*) through 12(*l*). In FIG. 12, the movement trajectory of the center of the first cam follower 94 is illustrated by a chain double-dashed line 77, and the movement trajectory of the center of the second cam follower 96 is illustrated by a chain double-dashed line 79. In FIG. 12, the third container transport device 16 for transporting container packs CP4 is not illustrated.

As illustrated in FIGS. 12(*a*) through 12(*c*), the mandrel head 40 moves along the linear section 47 by the action of the mandrel movement device 42. As illustrated in FIGS. 12(*d*) and 12(*e*), as the mandrel head 40 moves to the label fitting position β, the first cam plate 76 lifts the first cam follower 94 to bring the label feeding guide 86 into the label feeding position at which the guide bars 86*a* of the label feeding guide 86 project around the tip portion 84*a* of the mandrel shaft 84. At this time, it is preferred that the tip portions of the guide bars 86*a* move up to a position that is slightly higher than the tip portion of the mandrel shaft 84 but at which they do not come into contact with the pot portion P of the container C. This configuration allows more reliable fitting of labels L fed from the mandrels M on the peripheries of the pot portions P.

In synchronization with the upward movement of the label feeding guide 86, as illustrated in FIGS. 12(*d*) through 12(*g*), the second cam plate 78 lifts the second cam follower 96. Then, the lifting plate 88 starts moving upward from the standby position located below the label holding portion 85 of the mandrel M. The lifting plate 88 moves up to a label lifting position at which the upper surface of the lifting plate 88 is approximately flush with the upper ends of the guide bars 86*a* of the label feeding guides 86. As a result, the label L that is urged off the mandrel M by the lifting plate 88 is fitted on the outer periphery of the pot portion P of the container C from below the container.

After the label L is fitted on the outer periphery of the pot portion P, as illustrated in FIGS. 12(*h*) through 12(*l*), the lifting plate 88 moves down to a normal standby position, and as illustrated in FIGS. 12(*i*) through 12(*l*), the label feeding guide moves down from the label feeding position to the label receiving position. The mandrel head 40 is then ready for receiving a label at the label supply position α.

The container packs CP4 including the containers C having the pot portions P on which the labels L are fitted continue to be transported by the third container transport device 16 (see FIG. 1). During the transport, the labels L are held in place as they are kept in contact with the outer circumferential surfaces of the pot portions P by, for example, elastic restoration force (or resilience) of the labels L. While in this state, the container packs CP4 move to the fourth container transport device 18 as the suction transport belt 34 of the third container transport device 16 stops the suction. Subsequently, while the container packs CP4 on which the labels L are fitted pass through a heating device, which is not illustrated, the labels L heat-shrink; this completes the attachment of the labels L. The container packs CP4 are then fed to a subsequent process such as packaging.

As described above, according to the mandrel head 40 of this embodiment, the mandrel M includes the label holding portion 85 composed of a tapered surface, the label holding portion 85 being disposed above the lifting plate 88 positioned in the standby position. Accordingly, when fitted onto the mandrel M in the label supply position α, the label L can be held in a stable position on the label holding portion 85 without colliding with the lifting plate 88, and then can be transported into the label fitting position β. Thus, the label fitting operation can be suitably conducted in the label fitting position β, and label fitting failure can be reduced. The label L fitted onto the label holding portion 85 has a lower edge that is in contact with and held on the outer peripheral surface of the label holding portion 85. Accordingly, the label L fitted onto the mandrel M is effectively prevented from rotating and being displaced in the peripheral direction. As a result, the orientation of the label L with respect to the pot portion P of the container C can be precisely defined.

Referring again to FIG. 1, the label fitting system 10 of the illustrated embodiment may include the cleaning station 200 in the label fitting unit 20. It is preferred that the cleaning station 200 is disposed in a region where the mandrel heads 40 move along a circular trajectory after they are transferred in the linear section 47 by the mandrel movement device 42. In this region, the mandrel heads 40 can be cleaned well because the mandrel heads 40 attached to the belt 48 with a predetermined pitch PP move with a fan-shaped large clearance between the mandrel heads 40.

The cleaning station 200 is a device for cleaning contents that have spilled down from the containers C and have adhered to the mandrel heads 40 in the linear section 47 including the label fitting position β. For example, when the contents are powder, the cleaning station 200 may be configured to blow air to blow off and clean contents that have fallen to the mandrel heads 40.

Alternatively, the cleaning station 200 may be configured to blow a cleaning liquid such as water against the mandrel heads 40 to wash the mandrel heads 40. In this configuration, it is preferred that the drying station 300 is disposed downstream of the cleaning station 200 in the circulation path of the mandrel heads 40. The drying station 300 may be configured to, for example, blow warm air against the mandrel heads 40 to dry the mandrel heads 40.

By providing the cleaning station 200 as described above, the label fitting operation can be performed with the mandrel heads 40 being kept clean, and the cleanliness (sanitation) of the label fitting unit 20 can be maintained.

The cleaning station 200, and optionally the drying station 300, described above may be operated all the time, may be operated at fixed intervals, or may be operated either manually by an operator or automatically when contents have spilled.

The structure of the present invention is not limited to the above-described embodiments and their modifications, and various changes or improvements can be made within the scope of the features recited in the claims of the present application and their equivalents. For example, the present invention is not limited to the container pack of the above embodiment filled with contents, and can be widely applied to a film fitting head fitting a tubular film onto a body portion of any one of containers having various shapes from below the container, even in a state in which the container is not filled with the contents. The "body portion of the container" used herein includes a cap portion of the container. The present invention may be applied when the tubular film is fitted as a so-called cap seal.

DESCRIPTION OF REFERENCE CHARACTERS

10 Label Fitting System
12 First Container Transport Device
13 Conveyor Belt
14 Second Container Transport Device
16 Third Container Transport Device
18 Fourth Container Transport Device
20 Label Fitting Unit
22 Container Storage Section
24 Moving Tab
25 Container Transport Path
30, 49 Motor
34 Conveyor Belt or Suction Transport Belt
36 Suction Box
38 Slit
40 Mandrel Head
41 Clearance
42 Mandrel Movement Device
43 Base Frame
44 Drive Pulley
45 Shaft
46 Follower Pulley
47 Linear Section
50 Label Forming Unit
51 Mark Sensor
52 Inner Guide
53 Pitch Feeding Roller Pair
53*a* Drive Roller
53*b* Follower Roller
54 Cutting Unit
54*a* Fixed Blade
54*b* Movable Blade
55 Label Shaping Guide Component
55*a* Label Opening Portion
55*b* Label Shaping Portion
57*a*, 57*b* Shot Roller
58 Transfer Unit
58*a*, 58*b* Feed Belt Unit
59*a* Drive Pulley
59*b*, 59*c*, 59*d*, 59*e* Follower Pulley
59*f* Feed Belt
60 Base Plate
62 Bracket
64 Outer Side Attachment Component
66 Inner Side Attachment Component
68 Roller
70 Rail Component
72 Frame
74 Fixing Component
76 First Cam Plate
77 Supporting Plate
77, 79 Chain Double-dashed Line
78 Second Cam Plate
80 Top Cover
80*a* Front Wall
80*b* Back Wall
82*a* Front Lower Cover
82*b* Back Lower Cover
84 Mandrel Shaft
84*a* Tip Portion
84*b* Intermediate Shaft Portion
84*c* Lower Side Shaft Portion
85 Label Retention Portion (Film Retention Portion)
86 Label Feeding Guide (Film Feeding Guide)
86*a* Guide Bar
86*b* Lower Portion (of Label Feeding Guide)
87 Engagement Groove
88 Lifting Plate (Lifting Member)
89 Through Hole
89*a* Projecting Portion
90 Guide Component
91 Stopper
92*a* Connecting Plate
92*b* First Connecting Component
93 Bushing
94 First Cam Follower
95 Second Connecting Component
96 Second Cam Follower
98 Guide Groove
100 Groove
200 Cleaning Station
300 Drying Station
A Container Transport Direction
C Container
CP2, CP4, CP6 Container Pack
F, F1, F2 Flange Portion
L Label (Tubular Film)
LM Label Material
M Mandrel
OP Operator
Pot Portion (Body Portion)
PP Predetermined Pitch
Pot Pitch
Transport Pitch or Arrangement Pitch
S Lid
α Label Supply Position (Film Supply Position)
β Label Fitting Position (Film Fitting Position)

The invention claimed is:

1. A film fitting head for fitting a tubular film on a body portion of a container from below the container, the film fitting head comprising:

a mandrel comprising an outer peripheral surface providing a film holding portion, and a tapered tip portion comprising a frustum form and arranged between the film holding portion and a top of the mandrel, wherein the mandrel is configured to:

circulate through a film supply position and a film fitting position, receive the tubular film in an open state in the film supply position, hold the tubular film on the film holding portion below the tapered tip portion, move to the film fitting position, and guide and to feed the tubular film to the body portion of the container when the tubular film is lifted in the film fitting position and fitting the tubular film on the body portion of the container; and a lifting member configured to move up from a standby position to a film lifting position in the film fitting position to lift the tubular film held on the film holding portion of the mandrel toward the body portion of the container, wherein the mandrel includes the film holding portion disposed above the lifting member located in the standby position, the film holding portion has a tapered surface that is tapered down toward the tapered tip portion, and an outer peripheral length of a lower end of the film holding portion is set to be approximately equal to a peripheral length of the tubular film in an open state.

2. The film fitting head according to claim 1, wherein the mandrel comprises a mandrel shaft having an outer peripheral surface having a plurality of guide grooves formed in a shaft axial direction; and a plurality of film feeding guides movable in a vertical direction along the guide grooves between a film receiving position in which an upper end of each of the film feeding guides respectively arranged in the guide grooves of the mandrel shaft is retreated below the tapered tip portion and a film feeding position in which the upper end projects around the tapered tip portion to allow the tubular film to be fed in an open state to be approximately the same size as an outer circumferential shape of the body portion of the container, and the film holding portion composed of the tapered surface in the mandrel is comprised of external surfaces of the mandrel shaft and the film feeding guides.

3. The film fitting head according to claim 2, wherein the guide grooves of the mandrel shaft and the film feeding guides are, when viewed from the vertical direction, arranged in positions respectively corresponding to corners of the body portion having an approximately rectangular shape with rounded corner portions.

4. The film fitting head according to claim 1, wherein the lifting member comprises a through hole for receiving the mandrel.

5. The film fitting head according to claim 4, wherein the through hole comprises at least one projecting portion for engaging with a corresponding at least one groove of the mandrel.

6. The film fitting head according to claim 1, further comprising a vertical guide component arranged parallel to the mandrel, and wherein the lifting member extends from the guide component.

7. The film fitting head according to claim 1, wherein the tapered surface of the film holding portion comprises an angle with respect to an axial direction of the mandrel of between 2 degrees and 10 degrees.

* * * * *